United States Patent [19]

Dermond

[11] 4,046,485

[45] Sept. 6, 1977

[54] EARTH AND ROAD ROLLER WITH OPPOSITELY SKEWED TANDEM STEERING DRUMS

[75] Inventor: Hartley P. Dermond, S. Venice, Fla.

[73] Assignee: William H. Clark, Sharon, Pa. ; a part interest

[21] Appl. No.: 639,113

[22] Filed: Dec. 9, 1975

[51] Int. Cl.[2] ..... E01C 19/26

[52] U.S. Cl. ..... 404/123; 180/20; 180/79.3

[58] Field of Search ..... 404/123, 125, 126, 103, 404/122; 180/20, 79.3; 172/584, 595

[56] References Cited

U.S. PATENT DOCUMENTS

| | | | |
|---|---|---|---|
| 229,746 | 7/1880 | Patton | 404/122 |
| 639,829 | 12/1899 | Schaffer | 172/584 |
| 1,637,208 | 7/1927 | Wilson | 404/126 |
| 1,650,746 | 11/1927 | Stubbs | 404/126 |
| 2,612,090 | 9/1952 | Revers | 404/123 |
| 2,691,927 | 10/1954 | Denton | 404/125 X |
| 2,755,713 | 7/1956 | Harrison | 404/123 |
| 2,985,079 | 5/1961 | Clapper | 404/128 X |
| 3,541,931 | 11/1970 | Godberson | 404/122 |
| 3,827,819 | 8/1974 | Dermond | 404/126 |

*Primary Examiner*—Nile C. Byers

*Attorney, Agent, or Firm*—Lane, Aitken, Dunner & Ziems

[57] ABSTRACT

A roller for treating earth and pavement surfaces includes two steering and surface treating drums arranged one after the other and skewed in opposite directions relative to the line of roller travel.

5 Claims, 6 Drawing Figures

EARTH AND ROAD ROLLER WITH OPPOSITELY SKEWED TANDEM STEERING DRUMS

BACKGROUND OF THE INVENTION

This invention relates to an earth and road roller and, in particular, to an improved roller which provides for more uniform compaction of the surface being rolled. More particularly, this invention relates to a tandem roller which has two surface treating drums positioned one after the other and cooperate together to steer the roller.

As taught in U.S. Pat. No. 3,827,819, issued to the applicant for this application and as incorporated herein by reference, there are a number of industrial situations where it is necessary to form a smooth and uniformly compacted surface. One such situation is the subsurface and finish surface of an airplane landing strip. Uniformity of compaction and surface smoothness are also of a particular importance in the construction of roads designed to carry heavy loads. The failure to achieve uniform compaction in those and other situations tends to produce uneven surface wear with use. Furthermore, irregularities in the surfacing of a road, whether caused by uneven surface wear or by inadequate surface smoothing, provide localized areas where the surface deteriorates raidly under use.

Modern automobiles and even large trucks have greatly improved suspension and shock absorbing components which serve to provide a relatively smooth ride even over rough surfaces. However, although a ride may appear smooth to a passenger, the wheels of the vehicle are set in vertical motion by surface irregularities. The net result is that when a pneumatic rubber tire rolls over a surface irregularity which protrudes above the average road surface, the wheel momentarily leaves the surface and then lands with substantial downward force combined with a frictional drag. It has been found that such surface engagement tends to create a depression in the road surface. Similarly, when a moving wheel falls into a depression in the road surface, there is an erosion of surface material as the wheel moves out of and past the depression. Although the greatest road damage is caused by large and often overloaded trucks and trailers, small vehicles contribute to the problem. Thus, it can be seen that road surfaces should be constructed as smooth as possible.

Prior art road rollers usually include two or more large weighted drums. At least one of the drums is driven to move the roller and another drum is pivotally connected to the body of the roller so that it can be turned to steer the roller. The drums are connected to the roller body by axles which, except for the drum used to steer the roller, are maintained parallel to each other.

In one known earth roller, three drums are arranged in tandem; the front drum is used to steer the roller, while the rear and middle drums are not capable of turning, the rear drum being used to drive the roller.

Roads are typically formed of a foundation layer of relatively large stones which provide a bearing surface and drainage, an intermediate layer of small stones and binder and finally a surface layer which may be formed of a mixture containing bituminous materials. In such a road, as each layer is formed it is compacted by a road roller. Irregularities formed in the intermediate layer carry through to the bituminous layer. Even highways which are formed initially with a concrete surface oftentimes are refinished with a bituminous surface which is compacted by a road roller. It has been found that during such a refinishing operation the rough pattern typically found in the original concrete surface appears in a modified fashion in the bituminous surface when a conventional road roller is used. Conventional road rollers do not provide these surfaces with the degree of smoothness needed for long-lasting modern roads.

The invention in the above-mentioned patent (U.S. Pat. No. 3,827,819) was found to provide a solution to the problems discussed above. That patent teaches that better compaction and a smoother surface result when in a tandem roller one of the compacting drums is replaced by a pair of drums which are skewed in a side-by-side relationship relative to the line of travel of the roller. However, such a side-by-side configuration does not take advantage of the significantly more effective compacting and smoothing action of the three-axle tandem rollers described above, especially those which are adapted to exert extra heavy downward loads to high spots in the surface being rolled. Moreover, significant problems had to be overcome which are not applicable to side-by-side drums before the tandem drums could effectively be skewed. For example, the skew angle of the drums relative to each other in most applications should be maintained while the roller is turned and it is advantageous for an accommodation to be made to adjust the skew angle of the drums for different surface conditions, all of which preferably being accomplished without having to utilize and design new power plants, control mechanisms and the like.

SUMMARY OF THE INVENTION

In accordance with this invention, the problems discussed above are solved by providing a road roller with two steering and surface treating drums arranged one after the other where the drums are skewed relative to each other and in opposite directions relative to the line of travel of the roller when it is viewed from above or below. Moving means for moving the roller are provided, which in the case of a three-axle tandem roller could comprise a third drum connected to a motor. Alternatively, one or both of the two skewed drums could be adapted to be the moving means. The two drums skewed as described will move across the treated surface one after the other with a combined rolling and sliding motion, which operates to reduce the tendency of the roller to create surface irregularities and non-uniform material compaction and still permit easy steering.

The tandem steering drums are oppositely skewed and can be maintained at the same angle in opposite directions to provide an opposite and approximately equal effect on the steering of the roller if desired. The angle of the drums relative to each other is maintained while the roller is moving straight ahead or turning.

Adjustment means are provided for adjusting the skew angle of each drum so that the drums may be adjusted at an angle appropriate to the surface being treated and to take into account other terrain features. This feature also permits the skewed roller to be straightened when desired so that it can operate as a conventional roller.

In this way, a versatile three-axle tandem roller can be provided which combines the advantageous features of three-axle construction and skewed tandem drums. The angle of the drums relative to each other is maintained during all directions of travel of the roller and the skew angle of the drums is adjustable.

BRIEF DESCRIPTION OF THE DRAWINGS

For a better understanding of the invention, reference may be had to the following description of the preferred embodiments taken in conjunction with the accompanying drawings, in which.

DETAILED DESCRIPTION OF PREFERRED EMBODIMENTS

Figure 1:
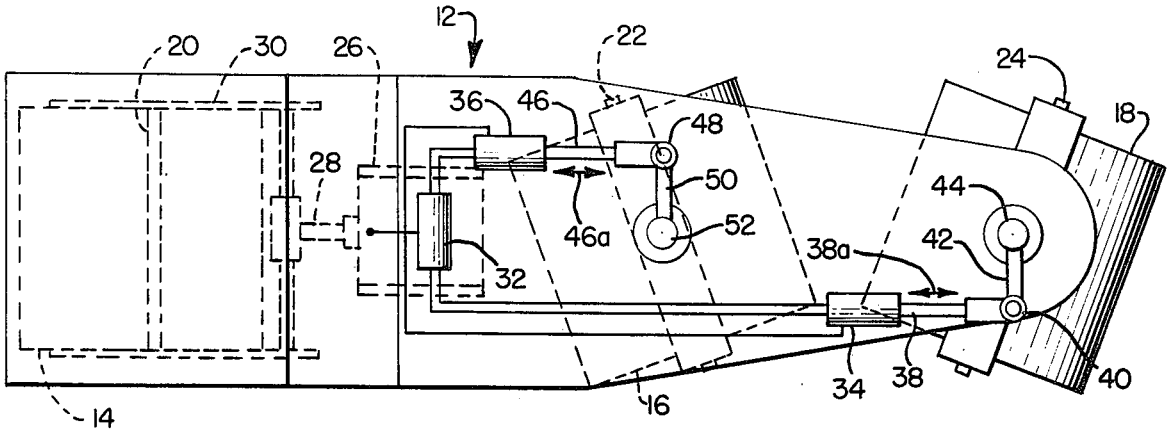
FIG. 1 is a top perspective view of a three-axle tandem road roller, two of the drums being in an oppositely skewed arrangement.

Now, a preferred embodiment of the invention will be described in detail in conjunction with the three-axle, tandem, road roller designated generally by reference numeral 12. The roller 12 includes the three surface treating drums 14, 16 and 18, which are respectively mounted on the axles 20, 22 and 24.

The drums 16 and 18 are used to steer the roller 12 in a manner which will be described in greater detail below. It should be noted that although the steering drums 16 and 18 are shown in FIGS. 1 and 2 as being located at the front portion of the roller 12, they may be located at the back or one at both ends of the three-axle roller.

Figure 2:
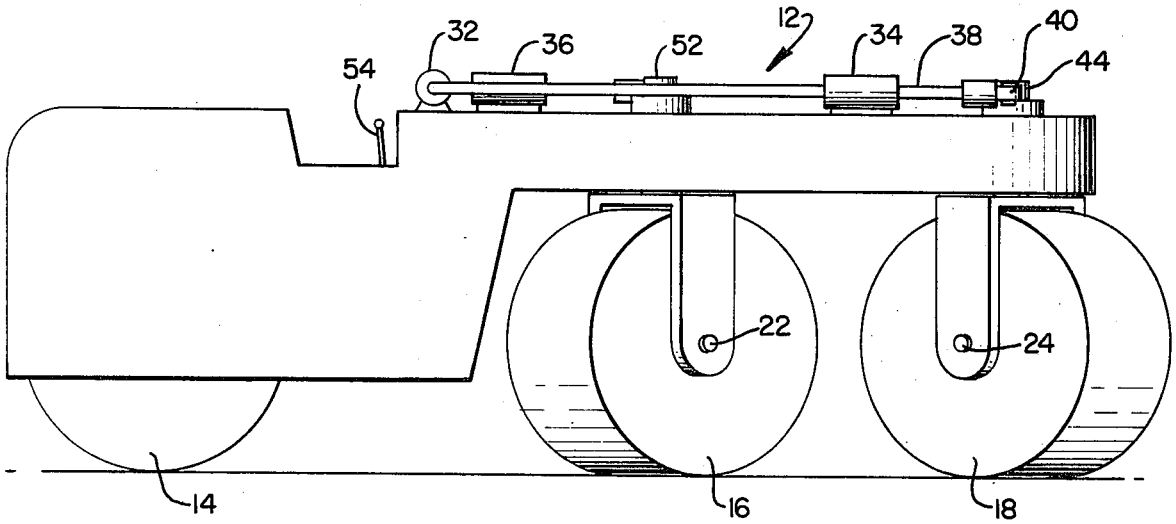
FIG. 2 is a side view of the road roller of FIG. 1.
Figure 3:
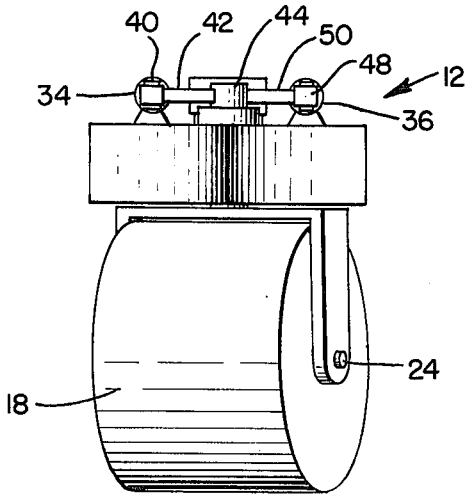
FIG. 3 is a front view of the road roller of FIGS. 1 and 2.

As shown diagrammatically in FIG. 1, the drum 14, which is mounted at the rear of the roller 12, serves as the driving or moving means for the roller 12. Alternatively, the driving drum could be located at the front of the roller 12 or between the steering drums 16 and 18. In another embodiment of the invention, the steering drums 16 and 18 could be utilized as the moving means, thereby eliminating the third drum. In the embodiment of the invention shown in FIG. 1, however, the drum 14 is powered in a conventional manner, for example, by mechanical action from a power plant located on the roller 12. The details of the motor and linkage are well known to the art and need not be described in detail.

In general, the motor 26 actuates the drive axle 28 which in turn drives the power mechanism 30 which, for example, can be in the form of a sprocket-chain drive.

The roller 12 is steered by turning the drums 16 and 18. The drums are turned by the hydraulic system shown in FIG. 1, which includes the accumulator 32, the hydraulic power cylinder 34 which is connected to the forward steering drum 18, and the second hydraulic power cylinder 36 which is connected to the rearward steering drum 16.

The ram member 38, which is activated by the hydraulic cylinder 34, is connected by the pin 40 to the arm 42 which in turn is connected to the vertical steering axle 44 of the drum 18.

The ram member 46, which is actuated by the hydraulic cylinder 36, is connected by the pin 48 to the arm 50 which in turn is connected to the vertical steering axle 52 of the drum 16. As shown, the ram members 38 and 46 are equal in length and the hydraulic cylinders 34 and 36 the same size.

The drums 16 and 18, as shown in FIG. 1, are skewed relative to each other and in opposite directions relative to the imaginary line extending between the pivot points of steering axles 44 and 52. In a typical case, each of the drums 16 and 18 may be skewed from 2° to 10° from this imaginary line. Such typical angle of skew is not to be considered to be limiting since the greater the skew angle the greater the improvement in roller performance. However, since there is a combined sliding and rolling action there is a tendency for a skewed drum to scour the surface being treated. This tendency increases with skew angle, and in the case of surface materials, e.g., a bituminous asphalt, having a high coefficient of friction the skew angle may, if necessary, be held to a lower value than in the case of materials, e.g., earth, having a lower coefficient of friction. With the construction of the steering mechanism described above, when the steering lever 54 (see FIG. 2) is moved to the first direction for steering to the right, for example, and the reverse direction for steering to the left, the accumulator 32 in cooperation with the respective hydraulic mechanisms causes the retractable rams 38 and 46 to travel an equal distance in the directions shown by the arrows 38*a* and 46*a*. In this way, the angle between the drums 16 and 18 is maintained constant while they are turned.

Figure 4:
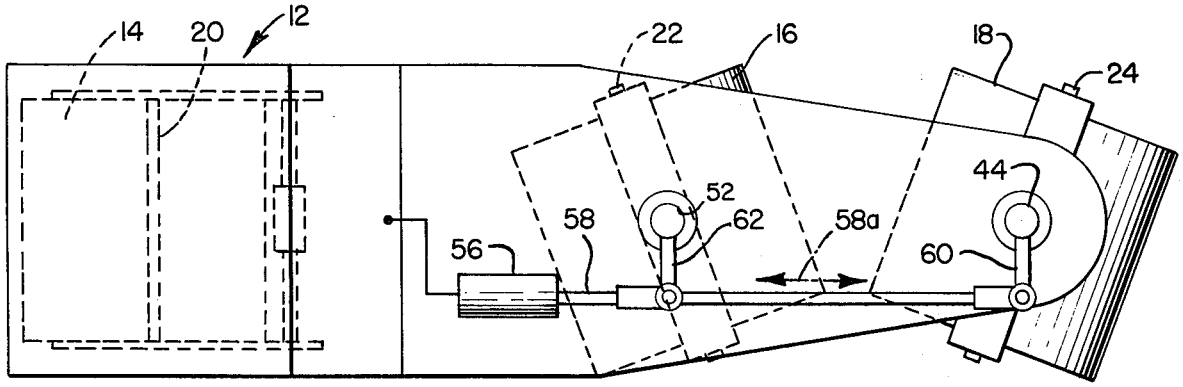
FIG. 4 is a top perspective view similar to that of FIG. 1, but showing an alternate steering mechanism.

Alternatively, rams of unequal lengths could be used and other variables changed to accomplish the same result, or a mechanism such as that shown in FIG. 4 could be provided where a single hydraulic cylinder 56 is connected to the retractable member 58, which in turn is connected by steering arms 60 and 62 to the vertical axles 44 and 52. Movement would be in the directions shown by the arrow 58*a*.

The skew angles of the drums 16 and 18 can be adjusted by providing a releasable connection between the steering arms and the drums or by providing for the steering arms or other component of the steering mechanism to be shortened or lengthened.

Figure 5:
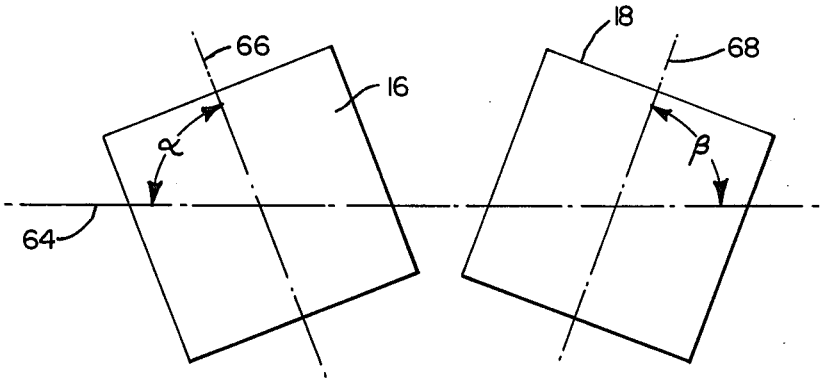
FIG. 5 is a diagrammatic view of the surface treating steering drums of FIGS. 1 and 2.
Figure 6:
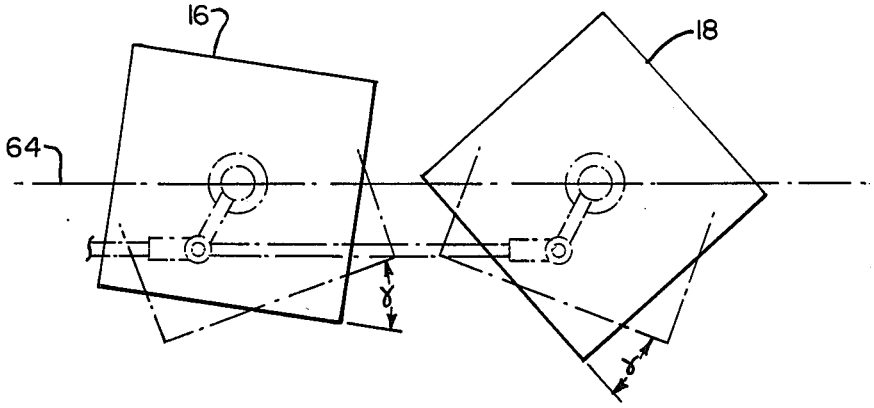
FIG. 6 is a diagrammatic view of the surface treating rollers as in FIG. 5 showing that the relative skew of the surface treating rollers is maintained while steering.

FIGS. 5 and 6 have been included to aid in understanding the maintenance of the angular relationship between the drums 16 and 18 during steering. The normal straight line of travel of the roller 12 is illustrated by the imaginary line extending between the pivot points of the steering axles 44 and 52, which in FIGS. 5 and 6 is designated by the reference numeral 64. The axis about which the drum 16 rotates is designated by the reference numeral 66 and the rotating axis of the drum 18 by reference numeral 68. The angle $\alpha$ represents the angle at which the drum 16 is skewed relative to line 64 and the angle $\beta$ represents the skew angle of the drum 18 relative to the same reference point. In most cases $\alpha$ and $\beta$ would be equal so that an opposite and equal effect on roller movement is provided.

As shown in FIG. 6, the rollers 16 and 18 have been turned to the right by operation of the hydraulic mechanism described above in conjunction with FIG. 4. The broken lines represent the drums in the position shown in FIG. 5, while the solid lines show the drums after they have been turned. The angle $\gamma$ represents the angle through which both the drums 16 and 18 have been turned. It can be seen that the angular relationship of the drums relative to each other remains the same even though their relationship to the line 64 has changed.

By skewing the drums 16 and 18 as described, the resultant successive rolling and sliding action in different directions provides an increased uniformity of compaction of the material and a significantly more even surface. The same action is maintained even during steering, and the angular relationship of the drums to each other can be maintained constant as the rollers are turned. The skew angle can be adjusted to adapt the roller to different surface conditions.

It should be understood that the invention described herein may be embodied in other forms without departing from the spirit or essential characteristics of the invention. The present embodiments are, therefore, to be considered in all respects as illustrative and not restrictive, and the scope of the invention is indicated by the claims rather than by the foregoing description. Accordingly, all changes which are embraced by the meaning and range of the equivalents of the claims are therefore intended to be covered by the claims.

I claim:

1. A roller for treating surfaces, comprising:

two surface-treating drums operatively connected to a frame structure and arranged one behind the other, each drum mounted on an independent, horizontal axle to permit rotation about their respective axes across the surface to be treated, the drums being disposed at a positively-selected skew angle relative to each other and in opposite directions relative to the normal direction of movement of the roller, the skew angle being positively selected from a range of between 2°–10° to adapt the roller to different surfaces to be treated;

vertical axle means connected to said frame structure and to the horizontal axle of each of the two drums so that each drum can be turned about a vertical axis, said vertical axle means being aligned along the normal direction of movement to the roller;

steering means on said frame structure for simultaneously turning both of said vertical axle means to maintain the positively-selected skew angle between the two drums during curvilinear movement of the roller, said steering means including steering control means coupled to said vertical axle means and actuation means operatively coupled to said steering control means;

adjustment means operatively connected to said steering means for adjusting the angle of skew of each drum relative to the normal direction of movement of the roller and relative to each other; and moving means connected to said frame structure for causing the drums to roll across the surface to be treated, including a third surface-treating drum rotatably mounted on a horizontal axis and disposed in tandem relative to said two drums and motor means operatively connected to said third drum.

2. The roller in claim 1, wherein the steering control means for each drum includes a steering arm of substantially equal length, and said actuation means moves both steering arms the same distance when the drums are being turned so that the positively-selectively skew angle of the drums relative to each other is maintained substantially constant while the drums are being turned.

3. The roller in claim 2, wherein the steering means further includes a separate hydraulic cylinder operatively connected to the steering control means for each drum.

4. The roller in claim 2, wherein the steering means further includes a single hydraulic cylinder operatively connected to the steering arm for both drums.

5. A roller for treating surfaces comprising:

three surface treating drums operatively connected to a frame structure, arranged in tandem and adapted to roll about their respective horizontal axes across the surface to be treated, two of said drums being arranged one behind the other and disposed at a positively-selected skew angle relative to each other, said angle being equal but in opposite directions relative to the normal line of movement of the roller and positively selected from a range of between 2°–10° to adapt the roller to different surfaces to be treated;

motor means on said frame structure and operatively connected to the third drum for rotating said third drum about its horizontal axis to move the roller; and steering means on said frame structure and operatively connected to both of said skew-disposed drums for selectively turning said drums simultaneously in the same direction for steering the roller, including a steering arm coupled to each of said skew-disposed drums and actuation means coupled to said steering arms for maintaining substantially constant the skew angle of the drums relative to each other during curvilinear movement of the roller.

* * * * *